United States Patent [19]

Hughes

[11] 4,023,322

[45] May 17, 1977

[54] THERMALLY INSULATING MATERIAL

[75] Inventor: Lionel S. Hughes, Port Talbot, Wales

[73] Assignee: British Steel Corporation, London, England

[22] Filed: Feb. 23, 1975

[21] Appl. No.: 660,187

[30] Foreign Application Priority Data

Feb. 26, 1975 United Kingdom ..... 8044/75

[52] U.S. Cl. ..... 52/608; 110/1 B; 266/283; 52/612

[51] Int. Cl.[2] ..... B31F 1/14; E04C 1/12

[58] Field of Search ..... 52/608–612, 52/405; 13/35; 432/247–253, 210, 211; 110/1 B; 266/283

[56] References Cited

UNITED STATES PATENTS

| | | | |
|---|---|---|---|
| 818,551 | 4/1906 | Peterson | 52/611 |
| 1,721,994 | 7/1929 | Greenslade et al. | 432/248 |
| 1,833,442 | 11/1931 | Solon | 52/609 |
| 2,263,848 | 11/1941 | Keaney | 13/35 |
| 2,658,332 | 11/1953 | Nicholson | 432/247 |

FOREIGN PATENTS OR APPLICATIONS

| | | | |
|---|---|---|---|
| 18,625 | 9/1908 | United Kingdom | 52/611 |
| 485,511 | 5/1938 | United Kingdom | 52/612 |

*Primary Examiner*—James L. Ridgill, Jr.
*Attorney, Agent, or Firm*—Bacon & Thomas

[57] ABSTRACT

A tile for lining an ingot mould or a hot-top box for the ingot mould has a back face for abutting the mould or box wall and four regions defined by the profiling of the front face. The lower region and a higher region are shaped so as to enable the molten metal within the mould or box to solidify with a "bottle-top" structure. An upper region above the higher region is shaped to maintain any anti-piping compound completely covering the molten metal as it solidifies. There is a top region above the upper region and the top region is of constant cross-section. The lower, higher and upper regions are shaped so that in the lined mould, or box a cavity is formed which decreases in cross-section from the top of the mould or box to a minimum cross-section,the cavity gradually widening in cross-section below this point. The tile may be made in two portions to assist transportation, the tile being assembled in situ. In this case one of the tile portions has a profiled face forming three regions equivalent to the lower, higher and upper regions of a monolithic tile.

22 Claims, 6 Drawing Figures

THERMALLY INSULATING MATERIAL

BRIEF SUMMARY OF THE INVENTION

Figure 1:
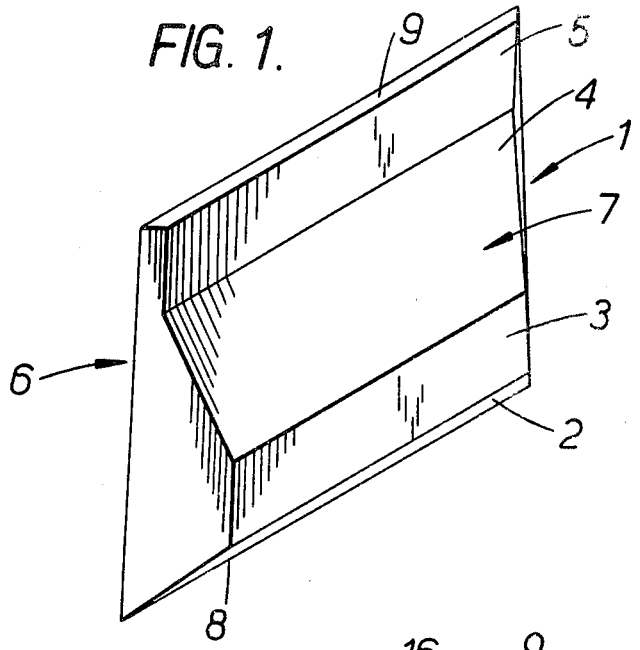

The present invention relates to thermally insulating material and is particularly concerned with insulating tiles for lining the inside surface of the top of an ingot mould or for lining the inside surface of a detachable top for the ingot mould such as a header box.

Such tiles are used in ingot moulds or hot-top boxes in combination with "anti-piping" compounds, added to the surface of the molten metal at the beinning of solidification, to slow down the rate of cooling of the head of molten metal. The object in this case is to reduce segregation, voids, piping etc., and thus reduce the cropping loss due to these defects. During the course of solidification the head of molten metal is ideally completely covered with an anti-piping compound which is in contact with the tiles while the tiles themselves provide further insulation for the hot metal disposed near to the head at the sides of the tiles.

While presently available tiles are adequate for insulation purposes they are generally profiled to produce solidified ingots with ends shaped in a rectangular or square manner. This shape is undesirable because slabs rolled from these ingots tends to display so-called "fish-tailed" ends which must be cropped from the slab before further treatment. This crop-loss can and does represent a considerable loss financially. In addition plant time may be lost due to holding up further operations so that the cropping operation can be performed. It would obviously be of considerable benefit if this loss could be reduced and it is an object of the present invention to reduce this loss.

According to one aspect of the present invention there is provided a tile for lining an ingot mould or detachable top therefor, the tile being adapted to abut the inner wall of the mould or detachable top, the tile having relatively higher and lower regions which are respectively shaped so as to produce within the lined mould or top a cavity of substantially constant minimum cross section subsequently increasing in a direction downwardly of the mould or top.

Preferably the tile has an upper region located above the higher region, the upper region being shaped to produce in the lined mould or top an upper cavity having a cross-section which decreases in a direction downwardly towards the cavity of substantially constant cross-section. Suitably the upper and lower regions of the tile are provided with cavity forming faces of either sloping or concave profile.

Conveniently the tile has a top region located above the upper region, the top region having a substantially constant cross-section.

According to another aspect of the present invention, thre is provided a tile for lining an ingot mould or detachable top therefor, the tile comprising a first portion for abutting the inner wall of the mould or detachable top and a second portion for attachment to the first portion, the second portion being shaped so as to produce within the lined mould or top a cavity which has a minimum cross-section at a position above the normally lower end of the tile.

Preferably the second portion has relatively higher and lower regions which are respectively shaped so as to produce within the lined mould or top a cavity of substantially constant minimum cross-section subsequently increasing in a direction downwardly of the mould or top.

Suitably the second portion has an upper region located above the higher region, the upper region being shaped so as to produce within the lined mould or top an upper cavity having a cross-section which decreases in a direction downwardly towards the cavity of substantially constant cross-section. Conveniently, the upper and lower regions of the second portion are provided with cavity forming faces of either sloping or concave profile.

The first portion of the tile may have a substantially constant cross-section.

Preferably the second portion of the tile is shaped in the form of a well so that when the second portion of the tile is attached to the first portion a space is formed between the portions. Suitably the well is partly or wholly filled with a thermally insulating compound before attachment, the thermally insulating compound being less dense than the portions of the tile. Conveniently the compound is in powder or granular form and may be exothermic. A suitable compound is vermiculite.

Embodiments of the invention will now be particularly described with reference to the accompanying drawings in which:-

Figure 2:
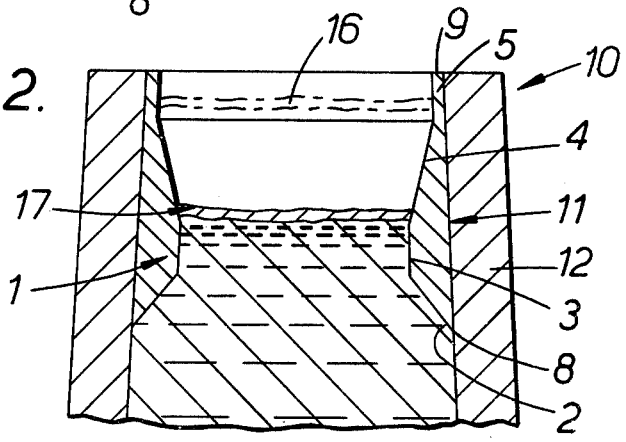
Figure 3:
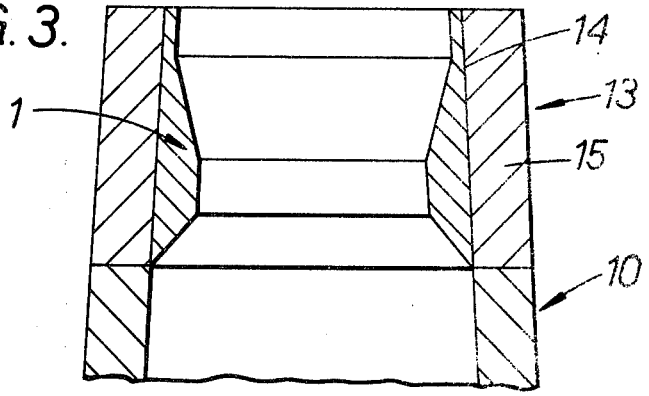
Figure 4:
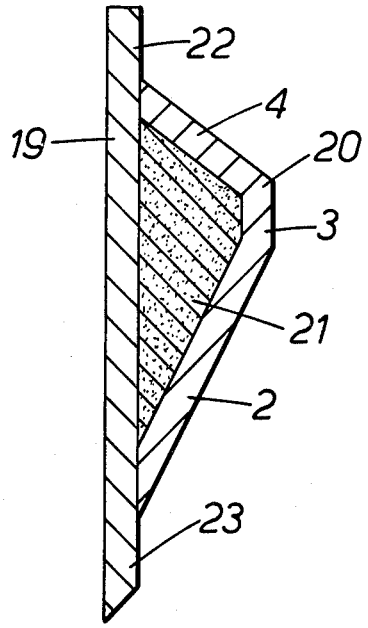
Figure 5:
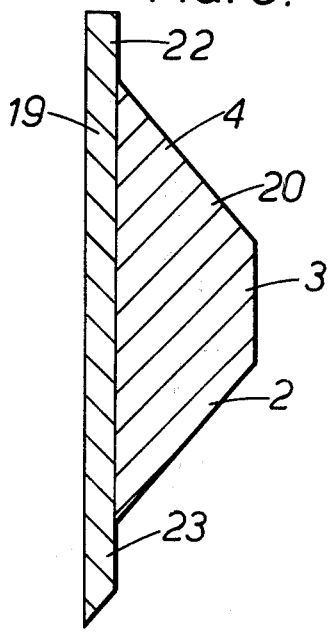
Figure 6:
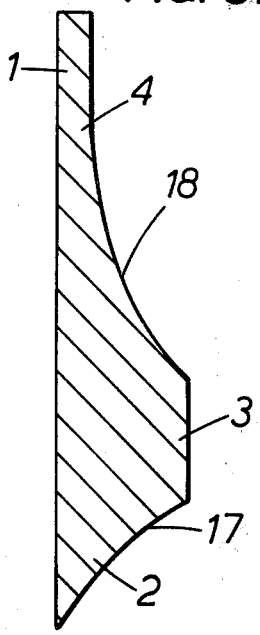

FIG. 1 is a front view in perspective of one form of monolithic tile,

FIG. 2 is a side view in section of a narrow end up ingot mould lined (at the top) with tiles similar to those of FIG. 1, FIG. 3 is a side view in section of a narow end up ingot mould upon which is located a header box lined with tiles similar to FIG. 1, FIG. 4 is a side view in section of a tile comprising two portions attached to each other, the space between the portions being filled with a thermally insulating compound, FIG. 5 is a side view in section of a tile comprising two portions attached to each other to produce a solid tile structure, and FIG. 6 is a side view of a modification of the tile shown in FIG. 1.

Referring to FIG. 1, the tile 1 is provided with four differently shaped regions 2 to 5 located between a rear planar face 6 which, in use, abuts the inner wall of the mould or header box. The tile 1 has an opposite face 7 which is profiled to produce the various regions or surfaces.

The tile 1 has a relatively lower first inclined surface 2 which is located between a relatively higher substantially planar surface 3 and the normally lower end 8 of the tile 1. The thickness of the tile 1 at the higher surface 3 of the tile is arranged to be a maximum. Furthermore the thickness is such that when the tiles 1 line the mould 10 or header box 13 as shown in FIGS. 2 and 3, the cavity formed between the tiles 1 is of substantially constant minimum cross-section. The thickness of the tile 1 at the lower inclined surface 2 is arranged to decrease in a direction downwardly of the mould 10 or header box 13 so that the cross-section of the cavity increases downwardly as shown in FIGS. 2 and 3. This thickness decrease may be obtained if the profiled face 7 is provided with a sloping portion at the lower surface 2.

The tile 1 is also provided with an upper second inclined surface 4 located between the planar surface 3 and a top substantially planar surface 5. The thickness of the tile 1 at the upper inclined surface is arranged to increase in a direction downwardly of the mould 10 or header box 13 from an initial value at the top surface 5 to the maximum value at the planar surface 3 which is substantially parallel with the rear planar face 6. In this case the profiled face 7 is provided with an outwardly sloping portion at the upper inclined surface 4 and the cavity formed between the tiles 1 at the upper surface 4 decreases in cross-sectional area from the top surface 5 to the planar surface 3.

The top surface 5 is located between the upper surface 4 and the normally upper end 9 of the tile 1. The top surface 5 has a substantially constant cross-section.

The sides of the tiles 1 should be bevelled or mitred as shown in FIG. 1 so that they can abut each other at each side when located in the mould or detachable top. Alternatively although not shown, the sides of the tile 1 can be straight and corner wedges can be placed at the corners of the mould or top to abut the tiles 1, the wedges having a similar shaped face 7 to the tiles 1.

Referring to FIG. 2 a narrow end up ingot mould 10 is shown in which the inner surfaces 11 of the ingot mould walls 12 are lined near the top with four tiles 1, one tile being located on each of the four walls 12 of the mould. The tiles 1 are secured to the walls 12 by pins or nails (not shown) which are fired through the tile 1 and into the wall 12 by a conventional firing gun. It will be appreciated that the tiles can be fixed by other suitable methods such as by wedges.

Referring to FIG. 3 a narrow end up ingot mould 10 is shown upon which is seated a conventional header box 13 which also has a narrowing upper end. While not shown in FIG. 3 the header box is bolted to the top of the ingot mould 10. The inner surface 14 of the header box walls 15 are lined with four tiles 1 which are secured to the header box walls 15 in the same manner as previously described.

The tiles themselves may be made of any convenient thermally insulating material such as silica or compounds including an alumino-silicate base.

Referring to FIG. 2, the beneficial effect of the tiles upon the ingot structure during and after casting will now be described. In use, molten metal, for instance molten steel, is poured into the cavity of the ingot mould 10 until it is almost filled with the metal and so that the top surface 5 of the tiles 1 is level with the surface of the molten metal. Anti-piping compound, in powder form, is then placed upon the surface of the metal until it completely covers the surface and thereby forms an effective thermally insulating barrier. The layer should in fact touch the tiles 1 initially to provide a complete barrier to heat loss from the molten metal.

During solidification the level of molten metal falls from an initial level to a final level as the metal contracts. When the metal reaches its final level solidification is virtually complete. At the same time as the metal falls the layer of anti-piping compound also falls. This is shown in FIG. 2 where the initial level of the layer 16 is represented by the broken line and the final lever of the layer 16 is shown as a cross-hatched area 17. The tiles 1 should in fact be dimensioned so that the length of the sloping upper region 4 is approximately the same as the distance through which the layer 16 falls during solidification as shown in FIG.2.

It will be observed from FIG. 2 that the top end of the solidified ingot exhibits the so-called "bottle top" shape due to the shape of the cavity formed between the higher region 3 and lower region 2 of the tiles 1. This is an advantageous ingot end shape from the point of view of slab rolling as crop-loss can be reduced to a minimum. The "bottle top" effect can be enhanced still further if the thickness of the tile at the higher region 3 is pronounced as shown in FIGS. 2 and 3.

Additionally however it has been found that the tiles of the present invention are able to maintain contact with the layer 16 during the whole of the solidification process thereby providing complete insulation. This contrasts sharply with the effect observed with conventional flat faced tiles where the layer 16 appears to move away from contact with the tiles as the level of molten metal falls due to the gradual widening of the mould cavity. Even where the mould cavity retains a constant cross-section the layer 16 moves away from contact with the tiles as the compound constituting the layer reacts and contracts in volume. The surface of the metal is thereby incompletely insulated so that piping and other defects are observed in the solidified ingot. In contrast the outwardly sloping face of the upper surface 4 of the tiles in the present invention ensures that the cavity between the tiles narrows over the distance through which the level of the molten metal falls so that the cover 16 is always maintained. In addition there is an increase in insulation as the thickness of the tile increases as the level of molten metal falls.

Referring to FIG. 6 the modified tile 1 has a lower surface 2 separated from an upper surface 4 by a substantially planar surface 3 of substantially constant thickness. The lower and upper surfaces 2, 4 respectively are each now provided with concave faces 17, 18 instead of the flat sloping faces of the tile shown in FIG. 1. It has been found that the ingots cast utilising these tiles exhibit even less crop loss on rolling to slab than the ingots produced with the tiles shown in FIG. 1. This is because the ingot ends are formed into a convex "bottle top" shape which has been found to be very beneficial for processing to slab. Furthermore the concave face 18 of the tile 1 enables the layer 16 (shown in FIG. 2) to provide an enhanced covering of the molten metal as it contracts during solidification in the mould.

The tiles of monolithic structure shown in FIGS. 1 to 3 and 6 and described in the foregoing have been found to aid in the production of ingots of shape promoting a substantial reduction in crop loss in comparison to conventional tiles of substantially constant thickness. In addition these tiles have enabled the solidification of the ingot to proceed with less cavity and void formation than is obtained when flat faced tiles are used. However it has been found that the handling, transporting and positioning of the tiles in the ingot mould or header box can be improved if the tiles are initially available in two portions. In this way the overall weight of the tiles can be spread.

FIG. 4 shows one form of tile comprising a first or rear portion 19 which is initially separate from a second or front portion 20. The rear portion 19 is of constant thickness and may be attached to the wall of the mould or header box by any convenient means for example by pins or nails as previously described. The front portion 20 which in use projects into the mould cavity and is well shaped is then attached to the backing portion 19 in a separate operation by means of a suitable adhesive such as a plastics glue or by rivets. If desired the well of the front portion 20 may be filled with a suitable thermally insulating compound before attachment to the rear portion 19. In FIG. 4 this has been done, the compound 21 being granular vermiculite so as further to slow down the rate of solidification of the molten head of metal. It will be appreciated that if the compound is lighter than the material from which the tile portions are made the transportion of the front portion 20 is made easier. It will be appreciated still more that there is no need to fill the well as shown in FIG. 4 and in this case of course there will be an air space formed between the front portion 20 and the backing portion 19. In other respects the assembled tile 1 shown in FIG. 4 is similar to those shown in FIGS. 1 to 3, and 6 and produces the same effects on ingot structure. However, in FIG. 4 the surfaces 2, 3 and 4 are formed due to the shape of the front portions 20. In addition however the tile in FIG. 4 has both top and bottom portions 22, 23 formed by the rear portion 19. The securing nails are preferably fired through these portions of the tile.

FIG. 5 shows another form of a tile in two portions. The tile 1 comprises a rear portion 19 and a front portion 20. In this case the front portion 20 is of integral structure as shown; otherwise the details of construction are similar to those described for the tile of FIG. 4.

I claim:

1. A tile for lining an ingot mould or detachable top therefor comprising a rear face for abutting the wall of the mould or top and a front face including surfaces substantially parallel and inclined to the rear face, there being a first inclined surface adjoining and, in the lined mould or top, disposed below a first parallel substantially planar surface wherein the separation between the rear and front faces is at a maximum in the region between the rear face and the first parallel surface.

2. A tile according to claim 1 in which the first inclined surface has a sloping or concave profile.

3. An ingot mould or detachable top therefore incorporating the tiles according to claim 1.

4. A tile according to claim 1 in which the front face includes a second inclined surface adjoining and, in the lined mould or top, disposed above the first parallel surface.

5. A tile according to claim 4 in which the second inclined surface has a sloping or concave profile.

6. A tile according to claim 4 in which the front face includes a second, parallel planar surface adjoining and, in the lined mould, disposed above the second inclined surface.

7. An ingot mould or detachable top therefor incorporating the tiles according to claim 4.

8. A tile as claimed in claim 1 in which the tile comprises two portions, a rear portion forming a rear face for the tile and a front portion fixedly attached to the rear portion and forming at least part of the front face of the tile including the first parallel surface and the first inclined surface.

9. A tile according to claim 8 in which the first inclined surface has a sloping or concave profile.

10. An ingot mould or detachable top therefor incorporating tiles according to claim 8.

11. A tile according to claim 8 in which the second portion is shaped in the form of a well so that a space is formed between the portions.

12. A tile according to claim 11 in which the space is partly or wholly filled with a thermally insulating compound.

13. A tile according to claim 12 in which the insulating compound is less dense than the tile portions.

14. A tile according to claim 12 in which the compound is vermiculite.

15. A tile according to claim 8 in which the front portion includes a second inclined surface forming at least part of the front face of the tile, the second inclined surface adjoining, and, in the lined mould or top, disposed above the first parallel surface.

16. A tile according to claim 15 in which the second inclined surface has a sloping or concave profile.

17. A tile according to claim 15 in which the front face of the tile includes a second parallel surface adjoining and, in the lined mould, disposed above the second inclined surface, the second parallel surface being constituted by part of the front face of the rear portion.

18. An ingot mould or detachable top therefor incorporating tiles according to claim 15.

19. A tile according to claim 15 in which the second portion is shaped in the form of a well so that a space is formed between the portions.

20. A tile according to claim 17 in which the space is partly or wholly filled with a thermally insulating compound.

21. A tile according to claim 20 in which the insulating compound is less dense that the tile portions.

22. A tile according to claim 20 in which the compound is vermiculte.

* * * * *